US010119554B2

(12) United States Patent
Liu et al.

(10) Patent No.: US 10,119,554 B2
(45) Date of Patent: Nov. 6, 2018

(54) ACOUSTIC RESONATORS FOR COMPRESSORS

(71) Applicants: Zheji Liu, Olean, NY (US); Scott D. Wisler, Olean, NY (US)

(72) Inventors: Zheji Liu, Olean, NY (US); Scott D. Wisler, Olean, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 977 days.

(21) Appl. No.: 14/457,580

(22) Filed: Aug. 12, 2014

(65) Prior Publication Data

US 2015/0071760 A1 Mar. 12, 2015

Related U.S. Application Data

(60) Provisional application No. 61/876,304, filed on Sep. 11, 2013.

(51) Int. Cl.
*F04D 29/66* (2006.01)
*F04D 29/44* (2006.01)

(52) U.S. Cl.
CPC ..... *F04D 29/665* (2013.01); *F04D 29/441* (2013.01)

(58) Field of Classification Search
CPC .... F04D 29/44; F04D 29/441; F04D 27/0207; F04D 27/0215; F04D 27/023; F04D 27/0238; F04D 29/66; F04D 29/661; F04D 29/663; F04D 29/665
See application file for complete search history.

(56) References Cited

U.S. PATENT DOCUMENTS 2,656,096 A * 10/1953 Schwarz ..... F04D 29/441 415/115
3,362,629 A * 1/1968 Papapanu ..... F04D 29/441 217/52
4,579,509 A * 4/1986 Jacobi ..... F01D 17/143 415/199.1
6,550,574 B2 * 4/2003 Liu ..... F04D 29/4213 181/213
6,669,436 B2 * 12/2003 Liu ..... F04D 29/665 181/286
6,918,740 B2 * 7/2005 Liu ..... F04D 29/665 415/1
7,014,421 B2 * 3/2006 French ..... F01D 17/143 415/197
7,722,316 B2 * 5/2010 Scarinci ..... F04D 29/444 415/119

* cited by examiner

*Primary Examiner* — Jason Shanske
*Assistant Examiner* — Julian Getachew

(57) ABSTRACT

A compressor and a method for reducing acoustic energy generated in the compressor are provided. The compressor may include a housing defining a fluid pathway and a shunt hole fluidly coupling the fluid pathway with another component of the compressor. The compressor may also include an impeller at least partially disposed in the fluid pathway and coupled with a rotary shaft. The impeller may be configured to rotate with the rotary shaft to direct a process fluid through the fluid pathway of the compressor. A disk may be disposed between the fluid pathway and the shunt hole. The disk may define a plurality of openings fluidly coupling the fluid pathway with the shunt hole and configured to reduce acoustic energy generated in the compressor.

11 Claims, 7 Drawing Sheets

ACOUSTIC RESONATORS FOR COMPRESSORS

CROSS-REFERENCE TO RELATED APPLICATIONS

This application claims priority to U.S. Provisional patent application having Ser. No. 61/876,304, which was filed Sep. 11, 2013. This priority application is hereby incorporated by reference in its entirety into the present application to the extent consistent with the present application.

BACKGROUND

Reliable and efficient compressors, such as centrifugal compressors, have been developed and are often utilized in a myriad of industrial processes (e.g., petroleum refineries, offshore oil production platforms, and subsea process control systems). In the centrifugal compressors, undesirably high levels of noise may be generated near regions of an impeller outlet and a diffuser inlet. For example, in the centrifugal compressor, process fluids may flow through the regions of the impeller outlet and the diffuser inlet at velocities sufficient to generate the high levels of noise. The noise generated may often have a frequency band in a frequency range that human ears may be sensitive to; and thus, may create an undesirable working environment for nearby operators. In addition to presenting a nuisance to the nearby operators, the noise may also result in unintended vibrations and structural damage of the compressors and/or components thereof.

In view of the foregoing, the compressors may often incorporate noise attenuators to reduce the high levels of noise. For example, external attenuators or devices, such as enclosures and wraps, may often be utilized to reduce the high levels of noise. Utilizing the external devices, however, often leads to increased overall cost as the external devices are often provided as an add-on for the already manufactured compressors. Further, the external devices reduce the high levels of noise by insulating structural components of the compressor, and not by reducing the generation and/or excitation of sound waves traversing along or through fluid passages of the compressors. Due to the limitations of the external devices, internal devices, such as acoustic liners or resonators, have been developed and are often disposed adjacent diffuser channels of the compressors to attenuate the noise generated by the process fluids. The acoustic liners may attenuate the high levels of noise by exploiting the Helmholtz resonance principle. For example, the sound waves generated by the process fluids may oscillate through perforations and/or cells formed in the acoustic liner fluidly coupled with the diffuser channels. The oscillation of the sound waves via the cells may dissipate the acoustic energy and thereby attenuate the noise. The acoustic liner may also attenuate the noise by providing a local impedance mismatch to reflect the acoustic energy upstream. While the acoustic liners may provide a viable option for attenuating the noise, current designs and/or methods for implementing or integrating the acoustic liners in the conventional compressors may be improved. For example, the acoustic liners are often integrated in the conventional compressors such that the cells of the acoustic liners present "dead volumes" to the process fluids flowing through the diffuser channels.

What is needed, then, is an improved system and method for integrating acoustic liners in a compressor, such that the acoustic liners exhibit increased or enhanced performance in reducing acoustic energy generated in the compressor by introducing a net or biasing flow through the acoustic liners.

SUMMARY

Embodiments of the disclosure may provide a compressor including a housing that may define a fluid pathway and a shunt hole fluidly coupling the fluid pathway with another component of the compressor. The compressor may also include an impeller at least partially disposed in the fluid pathway and coupled with a rotary shaft. The impeller may be configured to rotate with the rotary shaft to direct a process fluid through the fluid pathway of the compressor. The compressor may further include a disk disposed between the fluid pathway and the shunt hole. The disk may define a plurality of openings fluidly coupling the fluid pathway with the shunt hole and configured to reduce acoustic energy generated in the compressor.

Embodiments of the disclosure may also provide a method for reducing acoustic energy generated in a compressor. The method may include fluidly coupling a fluid pathway formed in a housing of the compressor with another component of the compressor via a shunt hole. The method may also include rotating a rotary shaft and an impeller coupled with the rotary shaft to direct a process fluid through the fluid pathway to thereby generate the acoustic energy. The method may further include directing a portion of the process fluid from the fluid pathway to the shunt hole via a plurality of openings formed in a disk disposed between the fluid pathway and the shunt hole, such that the generated acoustic energy is reduced.

Embodiments of the disclosure may further provide another compressor including a housing that may define an impeller cavity and a diffuser channel fluidly coupled with and extending radially outward from the impeller cavity. An impeller may be disposed in the impeller cavity and coupled with a rotary shaft of the compressor. The impeller may be configured to rotate with the rotary shaft to direct a process fluid from the impeller cavity to and through the diffuser channel. The compressor may also include a disk disposed adjacent the diffuser channel and configured to reduce acoustic energy generated in the compressor. The disk may define an upstream opening fluidly coupled with an upstream portion of the diffuser channel, and a downstream opening fluidly coupled with a downstream portion of the diffuser channel. The disk may also define a passage fluidly coupling the upstream opening with the downstream opening.

Embodiments of the disclosure may also provide another method for reducing acoustic energy generated in a compressor. The method may include rotating a rotary shaft and an impeller coupled with the rotary shaft to direct a process fluid through a diffuser channel formed in a housing of the compressor. The method may also include directing a portion of the process fluid from a downstream portion of the diffuser channel to a downstream opening extending through a disk disposed adjacent the diffuser channel. The method may further include directing the portion of the process fluid from the downstream opening to an upstream opening extending through the disk via a passage formed in the disk to thereby reduce the acoustic energy generated in the compressor.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
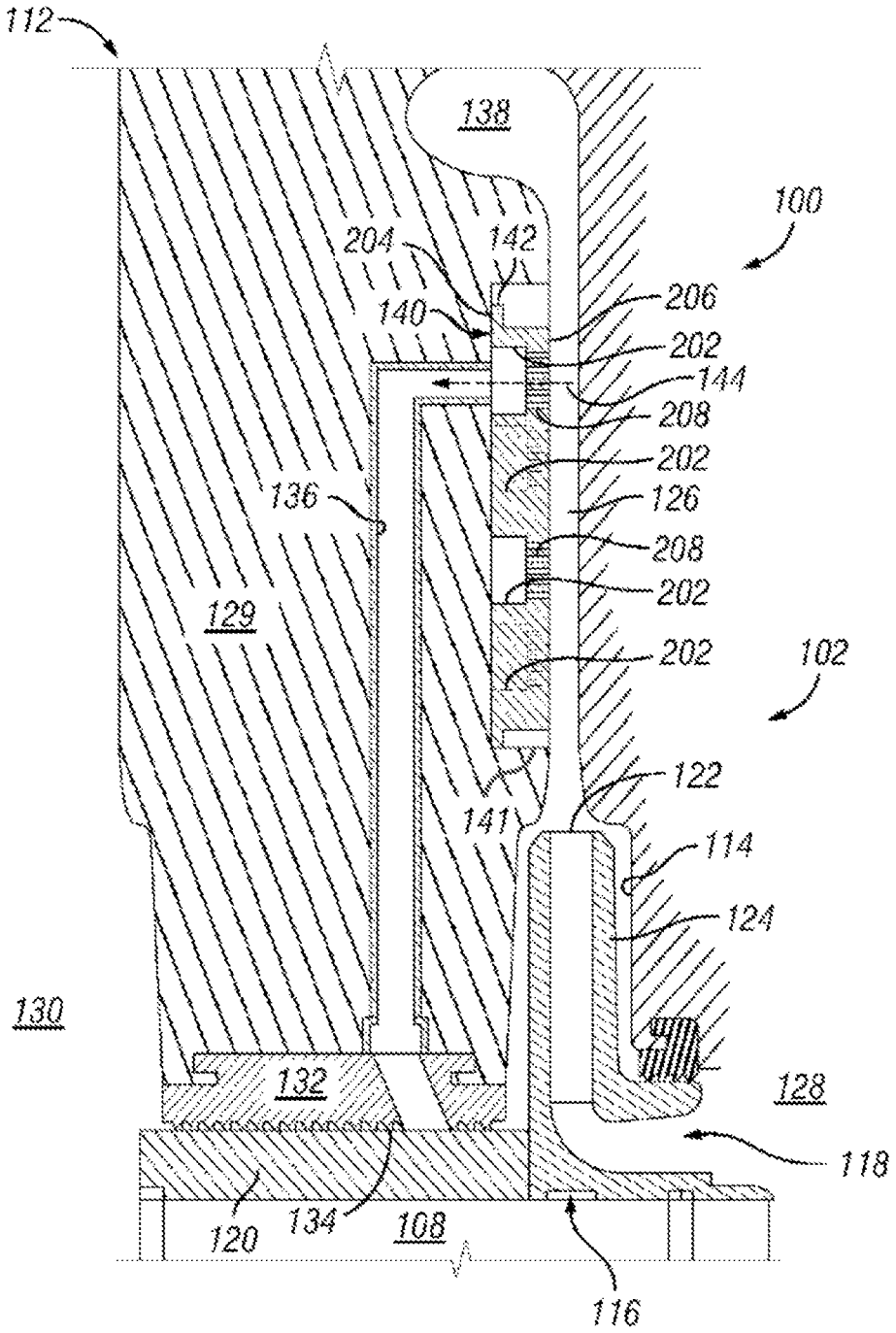
FIG. 1 illustrates a partial, cross-sectional view of a compressor including an acoustic liner, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a partial, cross-sectional view of a compressor 100 including an acoustic liner 140, according to one or more embodiments. The compressor 100 may be a centrifugal compressor, an axial compressor, a back-to-back compressor, or the like. In at least one embodiment, the compressor 100 may include one or more compression stages 102. Although the acoustic liner 140 is shown in association with a final compression stage 102 in FIG. 1, one of ordinary skill in the art will appreciate that the acoustic liner 140 may be associated with other compression stages, including an intermediate compression stage or a first compression stage. The compression stage 102 may include an impeller 116 having an inlet, such as an impeller inlet 118, and an outlet, such as an impeller outlet 122.

In an exemplary embodiment, the compressor 100 may include a housing 112 at least partially defining an impeller cavity 114 configured to receive the impeller 116. The housing 112 may also at least partially define a diffuser channel 126 extending radially outward from and fluidly coupled with the impeller cavity 114. The impeller cavity 114 and the diffuser channel 126 fluidly coupled therewith may form at least a portion of a fluid pathway extending through the compressor 100 through which the process fluid may be flowed. In at least one embodiment, the impeller 116 may be at least partially disposed in the impeller cavity 114 and configured to rotate therein to compress or pressurize the process fluid. For example, the impeller 116 may be coupled with a rotary shaft 108 configured to rotate the impeller 116 at a speed sufficient to draw the process fluid into the impeller cavity 114 via the impeller inlet 118 and compress the process fluid.

In at least one embodiment, the impeller 116 may include a plurality of impeller blades (one is shown 124) disposed about and coupled with the rotary shaft 108. The impeller blades 124 may be configured to discharge or direct the process fluid from the impeller 116 to the diffuser channel 126 via the impeller outlet 122. The diffuser channel 126 may receive the process fluid from the impeller 116 and direct the process fluid downstream to a volute 138 formed in the housing 112. The process fluid directed to the volute 138 may be discharged via an outlet (not shown) of the compressor 100. The diffuser channel 126 may be configured to convert kinetic energy (e.g., flow velocity) of the process fluid from the impeller 116 to potential energy (e.g., static pressure) by reducing the flow velocity thereof. Accordingly, the process fluid contained in the diffuser channel 126 may have a relatively higher pressure than the process fluid in the impeller 116. Further, the process fluid at an upstream portion of the diffuser channel 126 may have a relatively lower pressure than the process fluid at a downstream portion of the diffuser channel 126. For example, the process fluid at the upstream portion of the diffuser channel 126 (e.g., near or proximal the impeller outlet 122 of the impeller 116) may have a relatively lower pressure than the process fluid at the downstream portion of the diffuser channel 126 (e.g., near or proximal the volute 138).

In at least one embodiment, the compressor 100 may include a balance piston 120 coupled with the rotary shaft 108 and configured to rotate with the rotary shaft 108. In at least one embodiment, the balance piston 120 may be positioned adjacent the compression stage 102. In another embodiment, the balance piston 120 may be positioned near or proximal a high-pressure side of the impeller 116. For example, the balance piston 120 may be positioned near or proximal the impeller outlet 122 of the impeller 116.

In at least one embodiment, the compressor 100 may include an annular division wall 129 coupled with or otherwise forming at least a portion of the housing 112. For example, as illustrated in FIG. 1, the division wall 129 may form an annular portion of the housing 112. The division wall 129 and/or the housing 112 may at least partially define the diffuser channel 126 extending radially outward from the impeller cavity 114. In at least one embodiment, the division wall 129 may be configured to separate a high-pressure portion or side of the compressor 100 from a low-pressure portion or side of the compressor 100. For example, as illustrated in FIG. 1, the division wall 129 may be configured to separate a first side, or a high-pressure side 128, of the compressor 100 from a second side, or a low-pressure side 130, of the compressor 100.

In at least one embodiment, the compressor 100 may include a sealing substrate 132 coupled with or otherwise forming at least a portion of the division wall 129. The sealing substrate 132 may be fabricated from an abradable material, such as an aluminum alloy, a copper alloy, a powder metal alloy, a graphite-containing ferrous alloy, a polymer, combinations thereof, or the like. In at least one embodiment, the sealing substrate 132 may include a seal surface 134 configured to reduce leakage of the process fluid from the high-pressure side 128 to the low-pressure side 130. As illustrated in FIG. 1, the seal surface 134 may define a plurality of teeth extending radially inward toward the balance piston 120 to provide a labyrinth seal. It may be appreciated that the seal surface 134 of the sealing substrate 132 may include or define any type of seal known in the art, including, but not limited to, a hole-pattern seal, an aerodynamic swirl break seal, or the like.

In at least one embodiment, the housing 112 may define one or more gas conduits or shunt holes (one is shown 136) fluidly coupling the diffuser channel 126 or the fluid pathway extending through the compressor 100 with another one or more components of the compressor 100. For example, the shunt hole 136 may fluidly couple the diffuser channel 126 with one or more seals, bearings, carrier rings, balance pistons, rotary shafts, compression stages, or the like, or any combination thereof. In another example, as illustrated in FIG. 1, the shunt hole 136 may fluidly couple the diffuser channel 126 with the balance piston 120 coupled with the rotary shaft 108. In another embodiment, the shunt hole 136 may fluidly couple the diffuser channel 126 or the fluid pathway extending through the compressor 100 with one or more predetermined portions and/or cavities of the compressor 100. The predetermined portions and/or cavities of the compressor 100 may have a pressure that may be relatively greater than or relatively less than a pressure of the diffuser channel 126 or the fluid pathway extending through the compressor 100. As further described herein, the diffuser channel 126 may be in fluid communication with the shunt hole 136 via the acoustic liner 140. The shunt hole 136 may be configured to reduce or substantially prevent swirling of the process fluid by directing high-pressure process fluid from the high-pressure side 128 to the balance piston 120 and/or the rotary shaft 108. For example, as illustrated in FIG. 1, the shunt hole 136 may direct the high-pressure process fluid from the diffuser channel 126 to the balance piston 120 to reduce the swirling of the process fluid. Reducing the swirling of the process fluid may reduce aerodynamic cross-coupling effects and improve stability of the rotary shaft 108.

In at least one embodiment, one or more of the acoustic liners (one is shown 140) may be disposed in and/or coupled with the housing 112. For example, as illustrated in FIG. 1, the acoustic liner 140 may be disposed in a recess 141 formed in the division wall 129 of the housing 112. In at least one embodiment, the acoustic liner 140 may be fluidly coupled between the diffuser channel 126 and the shunt hole 136. The acoustic liner 140 may be configured to attenuate sound waves generated in the compressor 100, thereby reducing or substantially preventing noise associated with the sound waves. The acoustic liner 140 may be or include a disk, such as an annular ring or disk 142, disposed radially outward of the impeller 116 and coupled with the housing 112 between the diffuser channel 126 and the shunt hole 136. An upper portion of the annular ring 142 is illustrated in FIG. 1 and further illustrated in detail in FIGS. 2A and 2B.

Figure 2B:
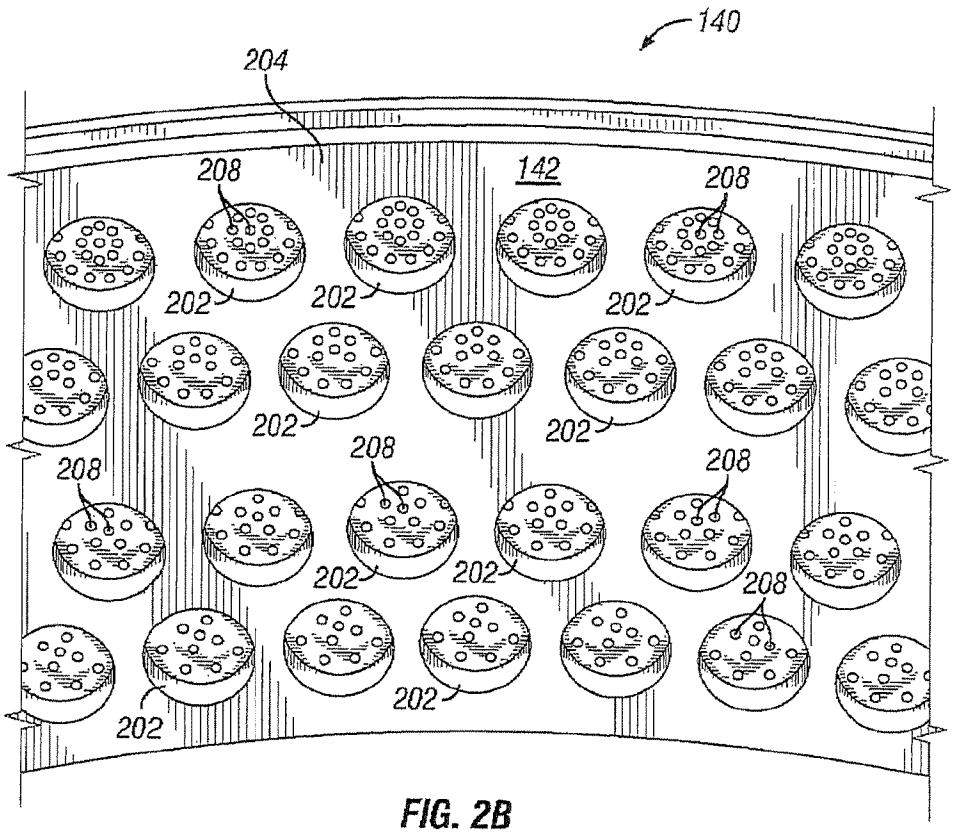
FIG. 2B illustrates a perspective view of a portion of the acoustic liner of FIG. 1, according to one or more embodiments disclosed.
Figure 2A:
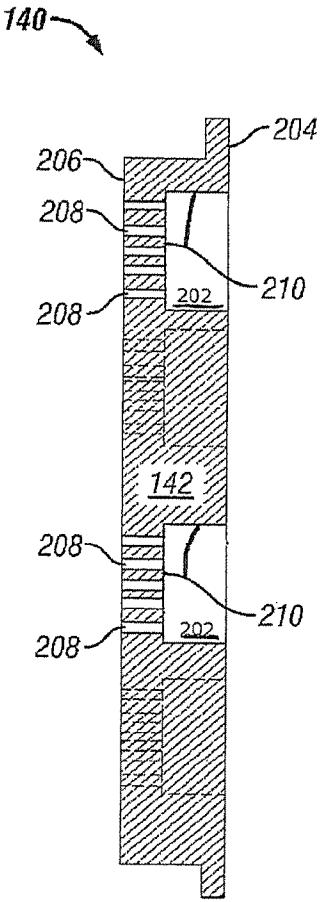
FIG. 2A illustrates a partial, cross-sectional view of the acoustic liner of FIG. 1, according to one or more embodiments disclosed.

As illustrated in FIG. 2A, the annular ring 142 of the acoustic liner 140 may define a series of cells 202, or openings, at least partially extending from a first surface 204 of the annular ring 142 toward a second surface 206 of the annular ring 142. In at least one embodiment, the cells 202 may be randomly disposed along the first surface 204 of the annular ring 142. In another embodiment, the cells 202 may be arranged in an ordered pattern along the first surface 204 of the annular ring 142. For example, as illustrated in FIG. 2B, the cells 202 may be arranged as one or more rows extending annularly along the first surface 204 of the annular ring 142. As further illustrated in FIG. 2B, the cells 202 in one of the rows may be staggered or offset with respect to the cells 202 in an adjacent row.

As further illustrated in FIG. 2A, the annular ring 142 of the acoustic liner 140 may define a series of holes 208, or openings, extending from an inner end surface 210 of each of the cells 202 to the second surface 206 of the annular ring 142. A plurality of the holes 208 may be associated with each of the cells 202. In at least one embodiment, the plurality of holes 208 may be randomly disposed along the inner end surface 210 of each of the cells 202. In another embodiment, the plurality of holes 208 may be disposed as an ordered pattern along the inner end surface 210 of each of the cells 202. While FIGS. 2A and 2B illustrate the cells 202 as having a circular or disc-like cross-section, and the holes 208 as bores, the shapes of the cells 202 and the holes 208 are merely exemplary. Accordingly, it may be appreciated that the shapes of the cells 202 and the holes 208 may vary without departing from the scope of the disclosure. In at least one embodiment, the first surface 204 may be parallel to the second surface 206 and/or the inner end surface 210 of the cells 202. In another embodiment, the first surface 204 may be angled or have an angular orientation relative to the second surface 206 and/or the inner end surface 210 of the cells 202.

In at least one embodiment, as illustrated in FIG. 1, the acoustic liner 140 may be coupled with the housing 112 such that the first surface 204 of the annular ring 142 abuts or is disposed adjacent the division wall 129, thereby providing direct fluid communication between the shunt hole 136 and at least one of the cells 202. While FIG. 1 illustrates a single shunt hole 136, the compressor 100 may include a plurality of shunt holes 136 where a respective one of the plurality of shunt holes 136 may be fluidly coupled with a respective one of the cells 202. It may also be appreciated that a plurality of the cells 202 may be fluidly coupled with the single shunt hole 136. The acoustic liner 140 may also be coupled with the housing 112 such that the second surface 206 of the annular ring 142 abuts or is disposed adjacent the diffuser channel 126, thereby providing direct fluid communication between the diffuser channel 126 and the holes 208. Accordingly, the diffuser channel 126 may be fluidly coupled with the shunt hole 136 via the holes 208 and the cells 202 of the acoustic liner 140. In at least one embodiment, fluid communication between the diffuser channel 126 and the shunt hole 136 may provide a net or biasing flow of the process fluid from the diffuser channel 126 to the shunt hole 136 via the holes 208 and the cells 202, as indicated by arrow 144 in FIG. 1.

As previously discussed, the acoustic liner 140 may be configured to attenuate the sound waves generated in the compressor 100 to thereby reduce the noise associated with the sound waves. In at least one embodiment, the acoustic liner 140 may be optimized or tuned to attenuate the sound waves having a predetermined frequency or range of frequencies. For example, a volume and/or cross-sectional area of the cells 202 and/or the holes 208 may be varied (i.e., increased and/or decreased) to tune the acoustic liner 140 to the predetermined frequency or range of frequencies. In addition to varying the volume and/or the cross-sectional area of the cells 202 and/or the holes 208, the number and/or the length of the cells 202 and/or the holes 208 may be varied to tune the acoustic liner 140 to the predetermined frequency or range of frequencies.

In at least one embodiment, fluidly coupling the diffuser channel 126 with the shunt hole 136 via the acoustic liner 140 may increase the attenuation of the sound waves generated in the compressor 100. For example, without fluid communication through the acoustic liner 140, the cells 202 may function as "dead volumes." The biasing flow 144 from the diffuser channel 126 to the shunt hole 136 via the acoustic liner 140 may prevent the cells 202 from functioning as "dead volumes," and allow a flow (e.g., the biasing flow 144) of the process fluid through the acoustic liner 140. The flow of the process fluid through the acoustic liner 140 may increase the attenuation of the sound waves and/or allow the acoustic liner 140 to attenuate the sound waves over a broader range of frequencies.

Figure 3:
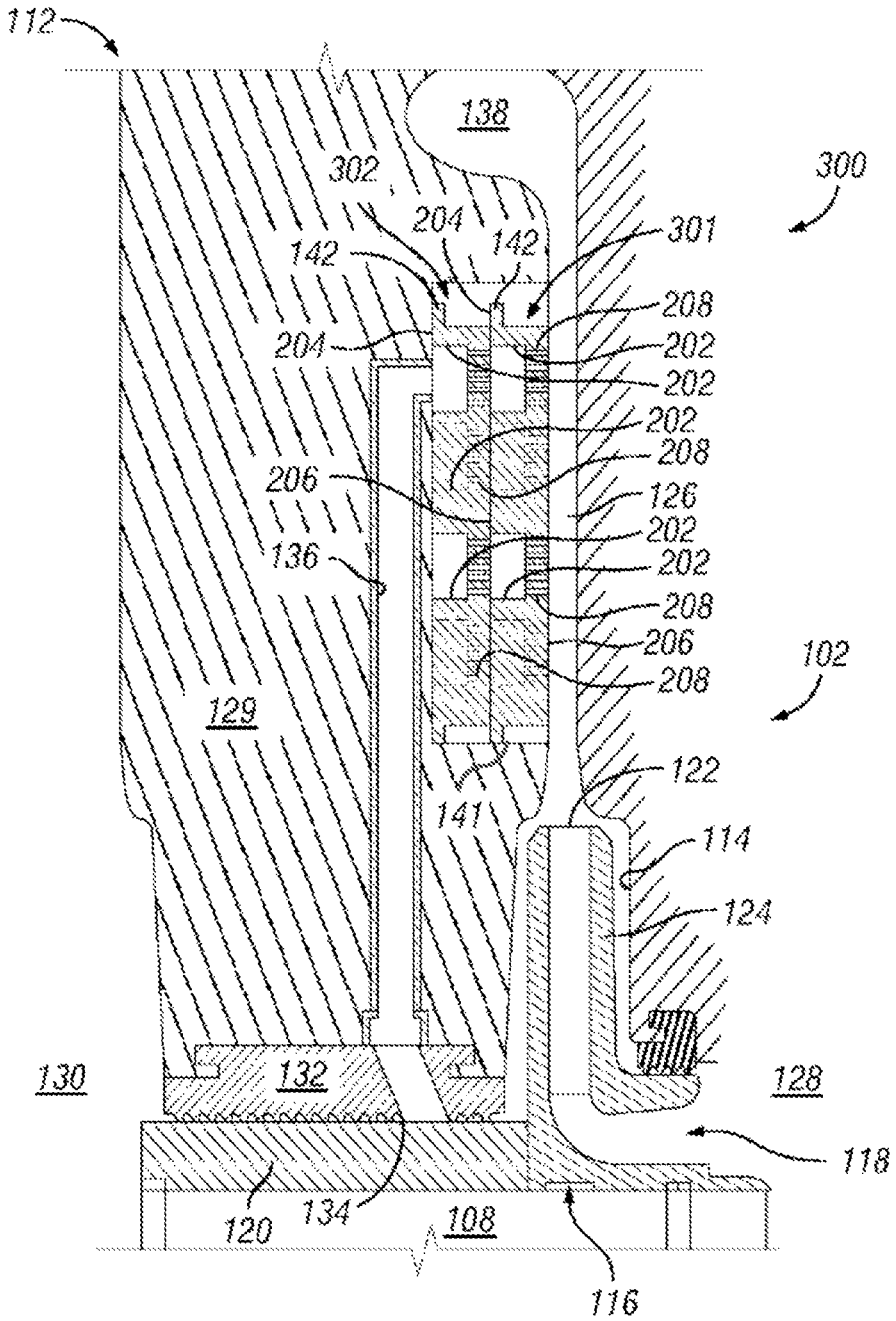
FIG. 3 illustrates another compressor including a plurality of acoustic liners, according to one or more embodiments disclosed.

In at least one embodiment, as illustrated in FIG. 3, a compressor 300 may include a plurality of acoustic liners (two are shown 301, 302). The compressor 300 may be similar in some respects to the compressor 100 described above and therefore may be best understood with reference to the description of FIG. 1 where like numerals designate like components and will not be described again in detail. As illustrated in FIG. 3, the compressor 300 may include a first acoustic liner 301 and a second acoustic liner 302 disposed adjacent and/or coupled with one another. The first and second acoustic liners 301, 302 may be similar in some respects to the acoustic liner 140 describe above and therefore may be best understood with reference to the description of FIGS. 2A and 2B. For example, the first and second acoustic liners 301, 302 may each include an annular ring 142 having a series of cells 202 partially extending from the first surface 204 of the annular ring 142 toward a second surface 206 of the annular ring 142, and a series of holes 208 extending from the second surface 206 to each of the cells 202.

As illustrated in FIG. 3, the second acoustic liner 302 may be disposed adjacent the first acoustic liner 301 such that the second surface 206 of the second acoustic liner 302 abuts the first surface 204 of the first acoustic liner 301. In at least one embodiment, the first acoustic liner 301 may be serially coupled with the second acoustic liner 302. For example, the first acoustic liner 301 may be coupled with the second acoustic liner 302 such that the cells 202 of the first acoustic liner 301 may be substantially aligned with the cells 202 of the second acoustic liner 302. In another example, the first acoustic liner 301 may be coupled with the second acoustic liner 302 such that the cells 202 of the first acoustic liner 301 may not be substantially aligned with the cells 202 of the second acoustic liner 302, but at least fluidly coupled with the cells 202 of the second acoustic liner 302. Accordingly, the diffuser channel 126 may be fluidly coupled with the shunt hole 136 via the first acoustic liner 301 and the second acoustic liner 302. For example, the diffuser channel 126 may be fluidly coupled with the shunt hole 136 via the respective holes 208 and cells 202 of the first and second acoustic liners 301, 302. Serially coupling the first acoustic liner 301 with the second acoustic liner 302 may allow the first and second acoustic liners 301, 302 to attenuate the sound waves over a broader range of frequencies as compared to the embodiment described with reference to FIG. 1 having the single acoustic liner 140.

Figure 4:
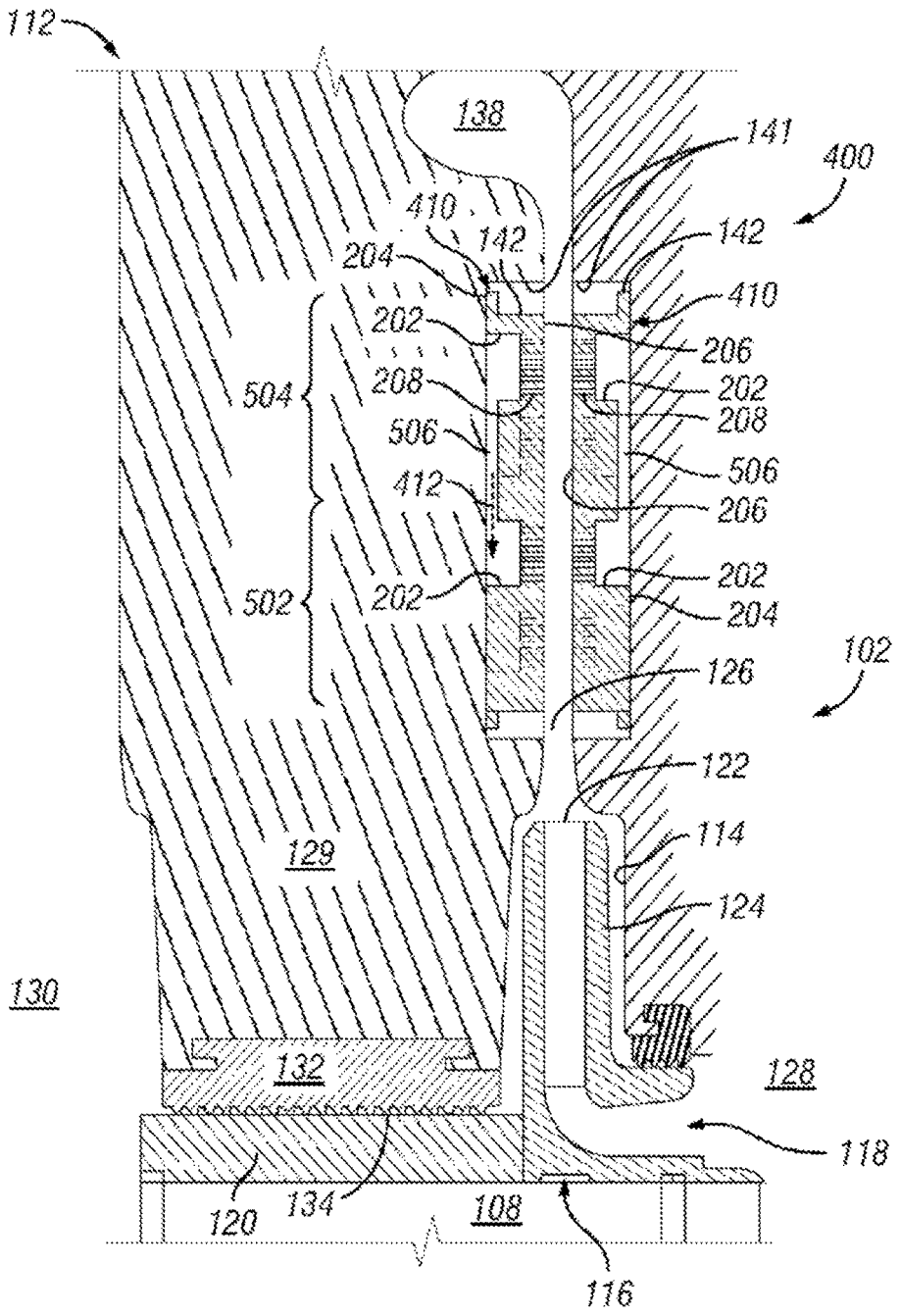
FIG. 4 illustrates a partial, cross-sectional view of another compressor including another acoustic liner, according to one or more embodiments disclosed.

FIG. 4 illustrates another compressor 400 that may be similar in some respects to the compressor 100 described above and therefore may be best understood with reference to the description of FIG. 1 where like numerals designate like components and will not be described again in detail. As illustrated in FIG. 4, the compressor 400 may include one or more acoustic liners (two are shown 410) disposed in the recesses 141 formed in the housing 112 and adjacent the diffuser channel 126. A partial, cross-sectional view of the acoustic liner 410 is illustrated in FIG. 4 and further illustrated in detail in FIGS. 5A and 5B. The acoustic liner 410 may be similar in some respects to the acoustic liner 140 described above and therefore may be best understood with reference to the description of FIGS. 2A and 2B where like numerals designate like components and will not be described again in detail.

Figure 5B:
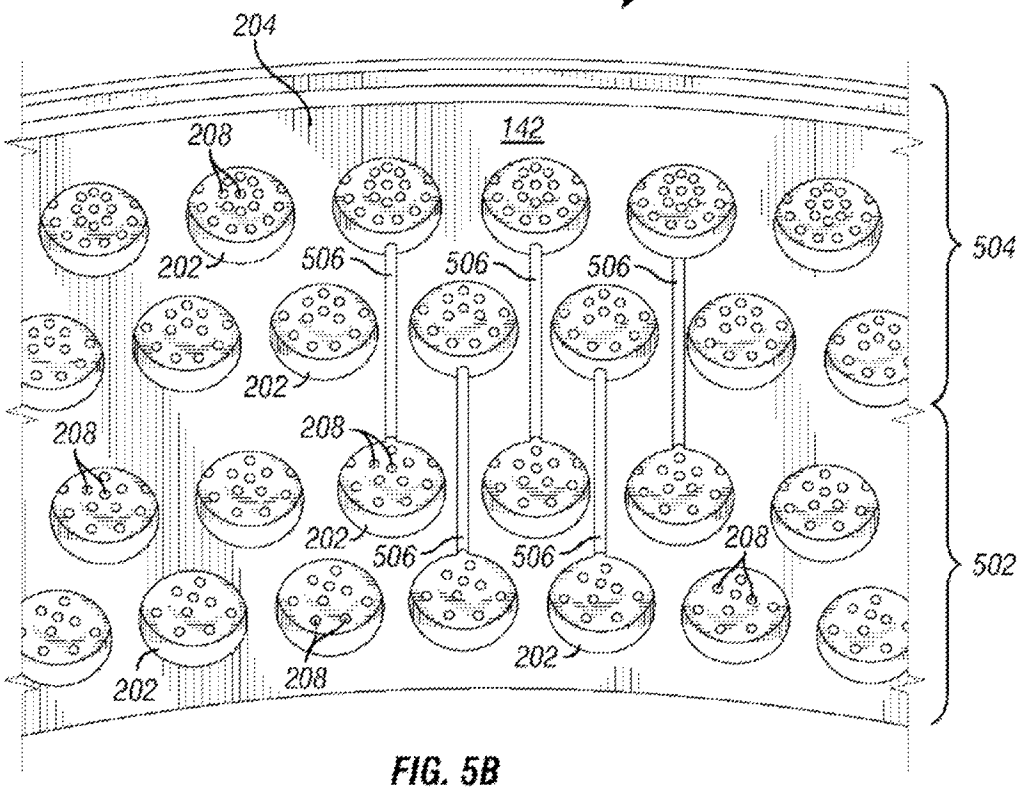
FIG. 5B illustrates a perspective view of a portion of the acoustic liner of FIG. 4, according to one or more embodiments disclosed.
Figure 5A:
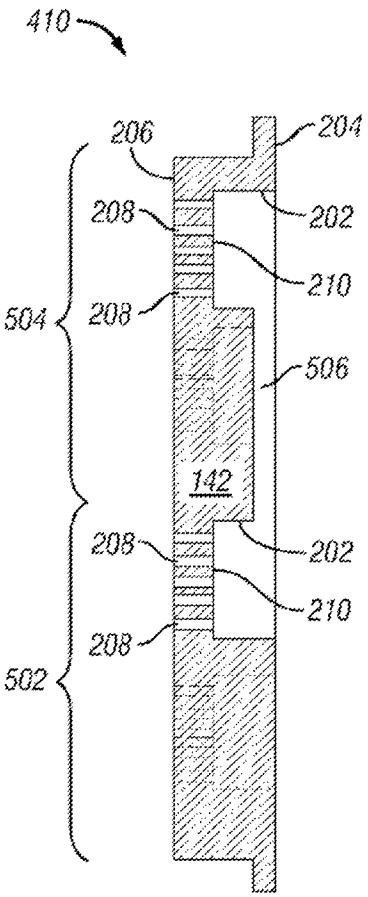
FIG. 5A illustrates a partial, cross-sectional view of the acoustic liner of FIG. 4, according to one or more embodiments disclosed.

As illustrated in FIGS. 5A and 5B, the acoustic liner 410 may include an inner annular portion 502 and an outer annular portion 504, which may be referred to as an upstream portion 502 and a downstream portion 504, respectively. In at least one embodiment, the annular ring 142 may define one or more channels or passages (five are shown 506) configured to fluidly couple two or more of the cells 202 with one another. For example, the annular ring 142 may define the passages 506 along the first surface 204 of the acoustic liner 410 to fluidly couple the cells 202 with one another. In at least one embodiment, the passages 506 may fluidly couple any one of the cells 202 disposed in the upstream portion 502 (e.g., upstream cell) with any one of the cells 202 disposed in the downstream portion 504 (e.g., downstream cell).

In at least one embodiment, as illustrated in FIG. 4, the acoustic liner 410 may be coupled with the housing 112 such that the second surface 206 of the annular ring 142 abuts or is disposed adjacent the diffuser channel 126, thereby providing fluidly communication between the cells 202 and the diffuser channel 126 via the holes 208. The acoustic liner 410 may also be coupled with the housing 112 such that the upstream portion 502 may be disposed adjacent the upstream portion of the diffuser channel 126 (e.g., near or proximal the impeller outlet 122 of the impeller 116), and the downstream portion 504 may be disposed adjacent the downstream portion of the diffuser channel 126 (e.g., near or proximal the volute 138).

As previously discussed, the process fluid at the upstream portion of the diffuser channel 126 may have a relatively lower pressure than the process fluid at the downstream portion of the diffuser channel 126. Accordingly, the cells 202 disposed in the downstream portion 504 of the acoustic liner 410 may exhibit a relatively higher pressure than cells 202 disposed in the upstream portion 502 of the acoustic liner 410, thereby resulting in a pressure differential therebetween. In at least one embodiment, the pressure differential between the upstream portion 502 and the downstream portion 504 may introduce a net or biasing flow of the process fluid from the cells 202 in the downstream portion 504 to the cells 202 in the upstream portion 502 via the passages 506, as indicated by arrow 412. The process fluid directed to the cells 202 in the upstream portion 502 may be directed back to the upstream portion of the diffuser channel 126 via the respective holes 208 in the upstream portion 502 of the acoustic liner 410.

In at least one embodiment, the biasing flow 412 through the passages 506 may increase the attenuation of the sound waves generated in the compressor 400. For example, the biasing flow 412 may prevent the cells 202 in the downstream portion 504 from functioning as "dead volumes." The biasing flow 412 of the process fluid from the cells 202 in the downstream portion 504 to the cells 202 in the upstream portion 502 via the passages 506 may allow the acoustic liner 410 to attenuate the sound waves over a broader range of frequencies.

Figure 6:
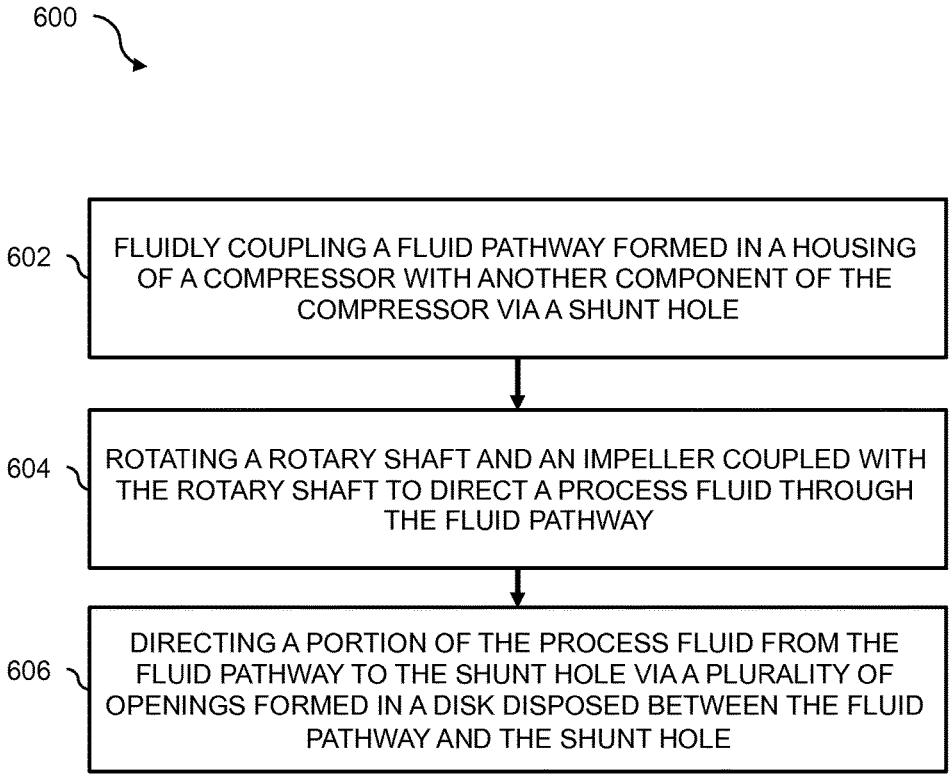
FIG. 6 illustrates a flowchart of a method for reducing acoustic energy generated in a compressor, according to one or more embodiments disclosed.

FIG. 6 illustrates a flowchart of a method 600 for reducing acoustic energy generated in a compressor, according to one or more embodiment. The method 600 may include fluidly coupling a fluid pathway formed in a housing of the compressor with another component of the compressor via a shunt hole, as shown at 602. The method 600 may also include rotating a rotary shaft and an impeller coupled with the rotary shaft to direct a process fluid through the fluid pathway, as shown at 604. Directing the process fluid through the fluid pathway may generate the acoustic energy. The method 600 may further include directing a portion of the process fluid from the fluid pathway to the shunt hole via a plurality of openings formed in a disk disposed between the fluid pathway and the shunt hole, as shown at 606.

Figure 7:
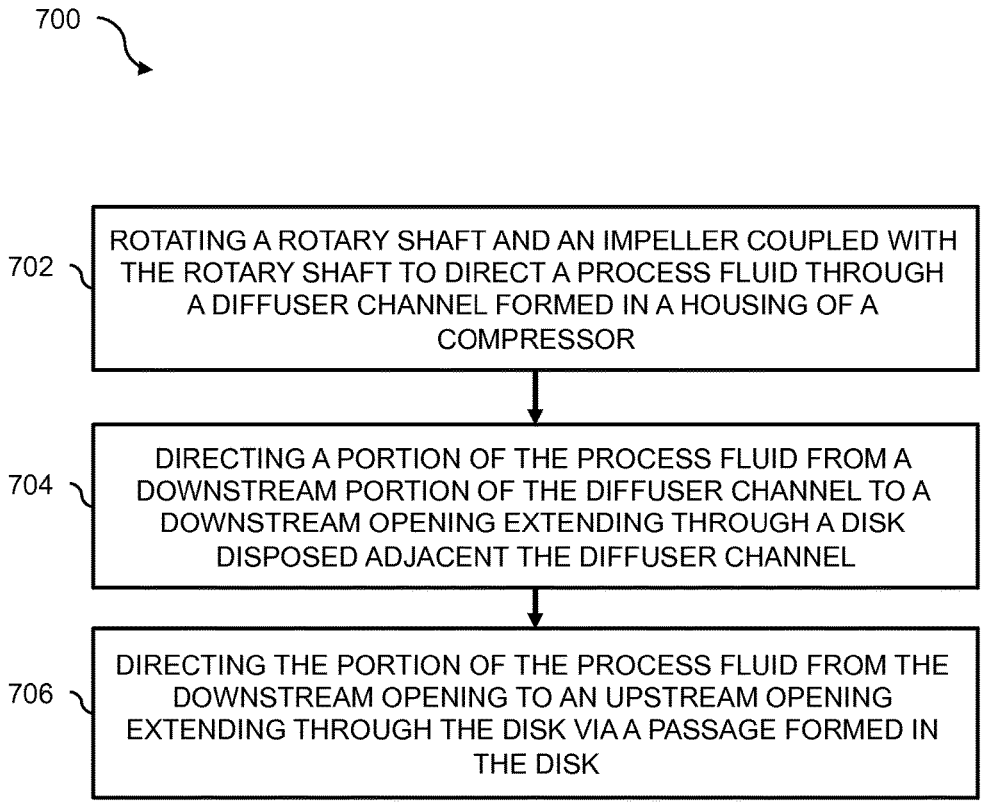
FIG. 7 illustrates a flowchart of another method for reducing acoustic energy generated in a compressor, according to one or more embodiments disclosed.

FIG. 7 illustrates a flowchart of another method 700 for reducing acoustic energy generated in a compressor, according to one or more embodiments. The method 700 may include rotating a rotary shaft and an impeller coupled with the rotary shaft to direct a process fluid through a diffuser channel formed in a housing of the compressor, as shown at 702. The method 700 may also include directing a portion of the process fluid from a downstream portion of the diffuser channel to a downstream opening extending through a disk disposed adjacent the diffuser channel, as shown at 704. The method 700 may further include directing the portion of the process fluid from the downstream opening to an upstream opening extending through the disk via a passage formed in the disk, as shown at 706.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A compressor, comprising:

a housing defining a fluid pathway and a shunt hole fluidly coupling the fluid pathway with another component of the compressor;

an impeller at least partially disposed in the fluid pathway and coupled with a rotatable shaft, the impeller configured to rotate with the rotatable shaft to direct a process fluid between a high-pressure side and a low-pressure side of the compressor, the process fluid directed through the fluid pathway and into the shunt hole to the another component, upon rotation of said rotatable shaft;

a disk disposed between the fluid pathway and the shunt hole, the disk defining a first axial surface facing the shunt hole, an opposing, second axial surface facing the fluid pathway, and a plurality of discrete, concave cell openings, formed integrally within the first axial surface of the disk, the plurality of discrete, concave cell openings separated from each other, each respective cell opening of the plurality of discrete, concave cell openings defined by an inner end surface that is contiguous with the first axial surface of the disk and axially separated from the first axial surface, each respective cell opening of the plurality of discrete, concave cell openings including a respective plurality of cell holes formed within the disk, each respective plurality of cell holes formed within the disk extending between the inner end surface of a respective cell opening of the plurality of discrete, concave cell openings, and the second axial surface, the plurality of discrete, concave cell openings and the respective plurality of cell holes formed within the disk fluidly coupling the fluid pathway with the shunt hole for passage of process fluid from the fluid pathway to the another component upon rotation of the rotatable shaft, wherein the another component of the compressor comprises a balance piston connected to the rotatable shaft, the shunt hole arranged to direct the process fluid into a passageway in the balance piston; and a sealing substrate including a seal surface arranged against a corresponding surface of the balance piston to reduce leakage of the process fluid between the high-pressure side and the low-pressure side of the compressor.

2. The compressor of claim 1, wherein the fluid pathway is formed from (i) an impeller cavity configured to receive the impeller, and (ii) a diffuser channel fluidly coupled with and extending radially outward from the impeller cavity, the diffuser channel fluidly coupled with the shunt hole via at least one of the plurality of discrete, concave cell openings and the respective plurality of cell holes formed within the disk of the at least one of the plurality of discrete, concave cell openings.

3. The compressor of claim 2, wherein the first axial surface of the disk is disposed adjacent the shunt hole such that at least one of the plurality of discrete, concave cell openings is directly fluidly coupled with the shunt hole.

4. The compressor of claim 2, wherein the second axial surface of the disk is disposed adjacent the diffuser channel such that at least one of the plurality of cell holes of at least one cell opening of the plurality of discrete, concave cell openings is directly fluidly coupled with the diffuser channel.

5. The compressor of claim 1, wherein the another component of the compressor further comprising one or more of a seal, or a bearing, or a carrier ring.

6. The compressor of claim 1, further comprising a passage formed in the disk between a pair of the discrete, concave cell openings of the plurality of discrete, concave cell openings, for fluid communication therebetween.

7. A method for reducing acoustic energy generated in a compressor, comprising:

fluidly coupling a fluid pathway formed in a housing of the compressor with another component of the compressor via a shunt hole and a disk disposed between the fluid pathway and the shunt hole, the disk defining a first axial surface facing the shunt hole, an opposing, second axial surface facing the fluid pathway, and a plurality of discrete, concave cell openings, formed integrally within the first axial surface of the disk that are separated from each other, each respective cell opening of the plurality of discrete, concave cell openings defined by an inner end surface that is contiguous with the first axial surface of the disk and axially separated from the first axial surface, each respective cell opening of the plurality of discrete, concave cell openings including a respective plurality of cell holes formed within the disk, each respective plurality of cell holes formed within the disk extending between the inner end surface of a respective cell opening of the plurality of discrete, concave cell openings, and the second axial surface, the plurality of discrete, concave cell openings and the respective plurality of cell holes formed within the disk fluidly coupling the fluid pathway with the shunt hole;

rotating a rotatable shaft and an impeller coupled with the rotatable shaft, to direct a process fluid through the fluid pathway, thereby generating acoustic energy;

reducing the generated acoustic energy by directing a portion of the process fluid flowing through the fluid pathway to the shunt hole and the another component, via at least one of the plurality of discrete, concave cell openings and the respective plurality of cell holes formed in the disk of the at least one of the plurality of discrete, concave cell openings, wherein the another component of the compressor comprises a balance piston connected to the rotatable shaft, arranging the shunt hole to direct the process fluid into a passageway in the balance piston; and arranging a sealing substrate including a seal surface against a corresponding surface of the balance piston to reduce leakage of the process fluid between a high-pressure side and a low-pressure side of the compressor.

8. The method of claim 7, wherein the fluid pathway is formed from (i) an impeller cavity configured to receive the impeller, and (ii) a diffuser channel fluidly coupled with and extending radially outward from the impeller cavity, the diffuser channel fluidly coupled with the shunt hole via at least one of the plurality of cell openings of the plurality of discrete, concave cell openings and the respective plurality of cell holes formed within the disk of the at least one of the plurality of discrete, concave cell openings.

9. The method of claim 7, further comprising disposing the disk in a recess formed in the housing.

10. The method of claim 7, further comprising varying respective profiles of respective concave cell openings of the plurality of discrete, concave cell openings and/or their respective pluralities of cell holes to reduce the generated acoustic energy over a predetermined range of energy frequencies.

11. The method of claim 7, said another component of the compressor comprising one or more of a seal, or a bearing, or a carrier ring.

* * * * *